US009138991B2

(12) United States Patent
Murase et al.

(10) Patent No.: US 9,138,991 B2
(45) Date of Patent: Sep. 22, 2015

(54) PRINTING APPARATUS AND CONTROL METHOD THEREOF

(71) Applicant: CANON KABUSHIKI KAISHA, Tokyo (JP)

(72) Inventors: Takeshi Murase, Yokohama (JP); Atsushi Sakamoto, Yokohama (JP); Minoru Teshigawara, Saitama (JP); Kei Kosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 13/912,725

(22) Filed: Jun. 7, 2013

(65) Prior Publication Data

US 2013/0335471 A1 Dec. 19, 2013

(30) Foreign Application Priority Data

Jun. 18, 2012 (JP) ..... 2012-137269

(51) Int. Cl.
*B41J 2/045* (2006.01)
*B41J 2/175* (2006.01)

(52) U.S. Cl.
CPC ..... *B41J 2/04563* (2013.01); *B41J 2/0458* (2013.01); *B41J 2/04536* (2013.01); *B41J 2/04588* (2013.01); *B41J 2/175* (2013.01)

(58) Field of Classification Search
CPC . B41J 2/04563; B41J 2/04598; B41J 2/04591
USPC ..... 347/14, 19
See application file for complete search history.

(56) References Cited

U.S. PATENT DOCUMENTS

| | | | | |
|---|---|---|---|---|
| 6,827,413 | B1 * | 12/2004 | Kawatoko et al. | 347/14 |
| 2007/0236522 | A1 * | 10/2007 | Takamiya et al. | 347/14 |
| 2008/0273063 | A1 * | 11/2008 | Wouters et al. | 347/85 |
| 2009/0244194 | A1 * | 10/2009 | Silverbrook | 347/61 |
| 2010/0231635 | A1 * | 9/2010 | Ramakrishnan et al. | 347/19 |
| 2012/0194587 | A1 | 8/2012 | Teshigawara et al. | |
| 2013/0093809 | A1 | 4/2013 | Kosaka et al. | |

FOREIGN PATENT DOCUMENTS

JP 07-209031 A 8/1995

* cited by examiner

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

One aspect of this invention is directed to suitable drive control in accordance with an output from the temperature sensor of a printhead. More specifically, a printing apparatus by using a printhead that includes heaters and a temperature sensor on a substrate and discharges ink by driving the heaters executes the following steps. First, when printing a test pattern by using a predetermined driving pulse in a maintenance mode, a detected temperature is stored as a reference temperature in a memory. Then, in a normal printing mode, the difference between a detected temperature and the stored reference temperature is calculated, and a driving pulse for driving the printhead is selected from a plurality of driving pulses based on the difference. The printhead is controlled to be driven using the selected driving pulse and print.

14 Claims, 9 Drawing Sheets

FIG. 6

| | PULSE CHANGE TIME (μs) | | | |
|---|---|---|---|---|
| PULSE NAME | LEADING EDGE OF FIRST PULSE | TRAILING EDGE OF FIRST PULSE | LEADING EDGE OF SECOND PULSE | TRAILING EDGE OF SECOND PULSE |
| Single | 0 | 0 | 1 | 2 |
| Double1 | 0 | 0.1 | 1.1 | 2 |
| Double2 | 0 | 0.2 | 1.2 | 2 |
| Double3 | 0 | 0.3 | 1.3 | 2 |
| Double4 | 0 | 0.4 | 1.4 | 2 |
| Double5 | 0 | 0.5 | 1.5 | 2 |

FIG. 10A

| ABSOLUTE TEMPERATURE | ~25°C | 25~30°C | 30~35°C | 35~40°C | 40~45°C | 45°C~ |
|---|---|---|---|---|---|---|
| DRIVING PULSE | Double5 | Double4 | Double3 | Double2 | Double1 | Single |

FIG. 10B

| TEMPERATURE RELATIVE TO REFERENCE | ~-7.5°C | -7.5~-2.5°C | -2.5~+2.5°C | +2.5~+7.5°C | +7.5~+12.5°C | +12.5°C~ |
|---|---|---|---|---|---|---|
| DRIVING PULSE | Double5 | Double4 | Double3 | Double2 | Double1 | Single |

PRINTING APPARATUS AND CONTROL METHOD THEREOF

BACKGROUND OF THE INVENTION

1. Field of the Invention

The present invention relates to a printing apparatus and control method thereof and, more particularly, to a printing apparatus including a full-line head and a control method thereof.

2. Description of the Related Art

Recently, inkjet printing apparatuses are becoming popular as printing apparatuses which implement high-quality color printing at low cost. As a recent trend, inkjet printing apparatuses adopt a structure using a head cartridge which is configured by integrating, with a printhead, an ink tank storing ink and is exchangeable from the printing apparatus main body. The head cartridge can advantageously reduce the cost by shortening the channel extending from the printhead to the ink tank, and reduce the ink consumption amount in suction recovery. For commercial use, a printing apparatus including a full-line head having a printhead printing width almost equal to the paper width is also available. Such an apparatus is used in a long term because an exchangeable full-line head can greatly prolong the service life.

Further, as a recent trend of printing apparatuses, the number of print elements of the printhead is increased to integrate the print elements at high density in order to meet a demand for higher image qualities. A high-resolution image can be printed by increasing the number of print elements and the resolution.

However, as the number of print elements increases, the printhead temperature rises more greatly owing to heat generated by the print elements. If the chip temperature of the printhead becomes high, the physical properties of discharge ink change. As a result, the ink amount per discharged ink droplet changes, changing the color appearance and degrading the printing quality. To avoid this, it is a common practice to arrange a temperature sensor in the printhead, adjust a driving pulse to be input to the printhead based on an output result from the temperature sensor, and stabilize the color appearance of a printed image. To implement this technique, the accuracy of printhead temperature detection is very important.

However, if a high-accuracy temperature sensor is arranged in a printhead which is handled as consumables on the premise of replacement, the cost of the printhead itself rises. To solve this problem, there has conventionally been proposed a technique of arranging a high-accuracy sensor in a printing apparatus main body and fitting the temperature sensor of a printhead in the sensor of the printing apparatus main body, instead of improving the accuracy of the temperature sensor in the printhead (see Japanese Patent Laid-Open No. 7-209031).

However, the technique disclosed in Japanese Patent Laid-Open No. 7-209031 assumes that the printing apparatus main body incorporates a high-accuracy sensor, so the cost of the printing apparatus main body rises.

In addition, the temperature is most likely to differ between the sensor inside the printing apparatus main body and the vicinity of the printhead, and the sensor arrangement position and fit-in sequence become complicated.

SUMMARY OF THE INVENTION

Accordingly, the present invention is conceived as a response to the above-described disadvantages of the conventional art.

For example, a printing apparatus and control method thereof according to this invention are capable of executing suitable drive control in accordance with an output from the temperature sensor of a printhead without arranging a high-accuracy sensor in the printing apparatus main body.

According to one aspect of the present invention, there is provided a printing apparatus comprising: a printhead including, on a substrate, a plurality of heaters which are driven by supplying a driving pulse to discharge ink, and a temperature sensor; a storage unit configured to store, as a reference temperature, a temperature detected by the temperature sensor when a test pattern was printed using a first driving pulse; a generation unit configured to generate print data by correcting input image data based on the test pattern; a determination unit configured to determine a second driving pulse to be supplied to the printhead in a printing operation based on the temperature detected by the temperature sensor in the printing operation, and the reference temperature; and a drive control unit configured to control the printhead to print the print data by driving the printhead using the second driving pulse determined by the determination unit.

According to another aspect of the present invention, there is provided a method of controlling a printing apparatus which prints on a print medium by using a printhead including, on a substrate, a plurality of heaters for discharging ink upon receiving a driving pulse, and a temperature sensor, comprising: printing a test pattern by using a first driving pulse; storing, as a reference temperature in a memory, a temperature detected by the temperature sensor when the test pattern was printed; generating print data by correcting input image data based on the test pattern; determining a second driving pulse to be supplied to the printhead in a printing operation based on the temperature detected by the temperature sensor and the reference temperature; and controlling the printhead to print the print data by driving the printhead using the determined second driving pulse.

The invention is particularly advantageous since no expensive temperature sensor need be integrated into the printing apparatus main body, the cost can be suppressed, and the printhead can be controlled to be driven by performing high-accuracy temperature control.

Further features of the present invention will become apparent from the following description of exemplary embodiments (with reference to the attached drawings).

BRIEF DESCRIPTION OF THE DRAWINGS

FIG. 6 is a table showing definition of a plurality of driving pulses used in the printhead by the time.

FIGS. 10A and 10B are tables showing the relationship between the head temperature and a driving pulse to be selected.

DESCRIPTION OF THE EMBODIMENTS

Figure 1A:
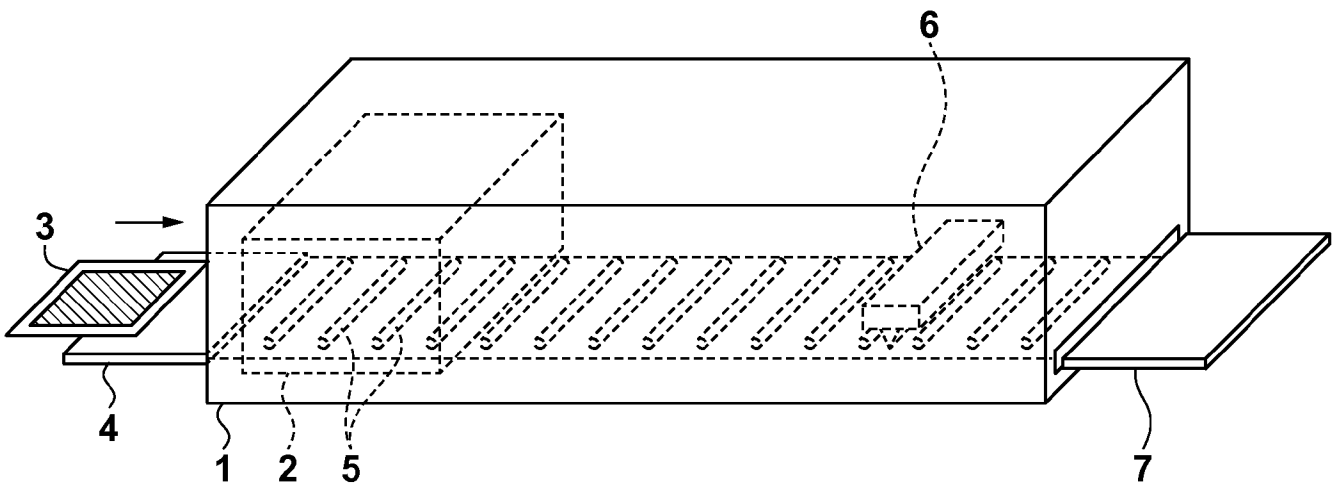
FIGS. 1A and 1B are a schematic perspective view and schematic side sectional view, respectively, showing the internal arrangement of an inkjet printing apparatus as an exemplary embodiment of the present invention.

Exemplary embodiments of the present invention will now be described in detail in accordance with the accompanying drawings. Note that the same reference numerals denote the same parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

A printhead substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

Next, an embodiment of an inkjet printing apparatus will be explained. The printing apparatus is a high-speed line printer which uses a rolled continuous sheet (print medium) and copes with both single-sided printing and double-sided printing. The printing apparatus is suitable for large-volume printing in a printing laboratory and the like.

The main purpose of the embodiment of the present invention is to output a stable-quality printed product by performing suitable drive control corresponding to an output value from the temperature sensor of a printhead during the printing operation without fitting the temperature sensor in an external sensor. As a result, the external sensor need not be arranged in the printing apparatus main body, reducing the cost of the printing apparatus main body.

User demand for higher image qualities is strong, and it is necessary to always output printed products of the same quality. To meet this demand, there are proposed many printing apparatuses having a function of creating a color correction parameter in image processing by using a reading apparatus such as a colorimeter or scanner.

The embodiment of the present invention suppresses the cost of the printing apparatus main body and achieves stable printing by setting, as a reference, a temperature obtained when color correction was performed, and adjusting a driving pulse to be input to the printhead in accordance with a difference from the reference temperature in a printing apparatus having the color correction function.

Figure 1B:
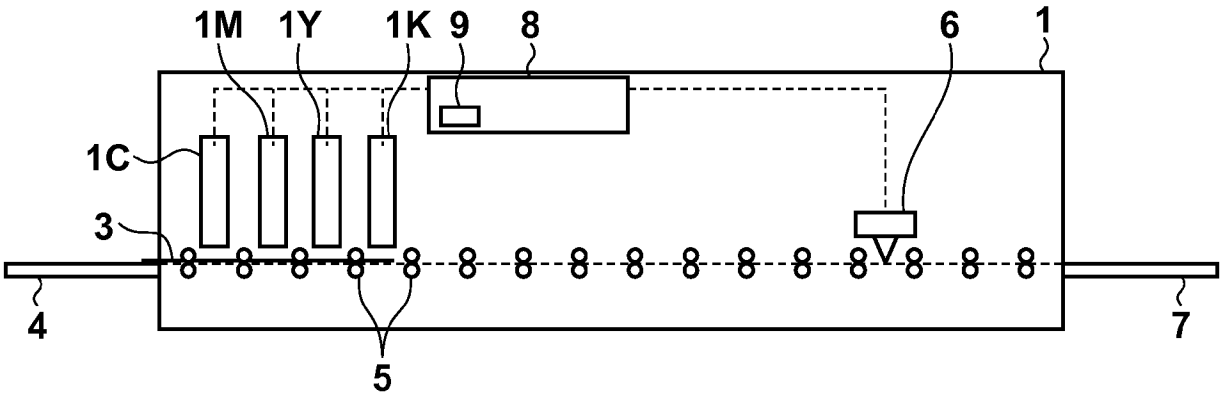

FIGS. 1A and 1B are views showing an outline of an inkjet printing apparatus (to be referred to as a printing apparatus hereinafter) as an exemplary embodiment of the present invention. FIG. 1A is a perspective view showing the overall arrangement, and FIG. 1B is a sectional view in a print medium conveyance direction (sub-scanning direction).

When a printing apparatus 1 performs normal printing, a print medium 3 fed from a paper feed tray 4 is conveyed by rotation of a plurality of conveyance rollers 5 arranged above and below the print medium. The print medium 3 is conveyed from left to right, as indicated by an arrow in FIG. 1A. The print medium 3 is printed by an inkjet printhead (to be referred to as a printhead hereinafter) 2, and discharged to a discharge tray 7. In the printing apparatus, the printhead 2 is driven under a plurality of driving conditions, a reading unit 6 reads an image printed on the print medium 3, and an optimal driving condition is specified from the result. The reading unit 6 is formed from a CCD camera or scanner (to be described later). A CPU 8 functioning as a control unit for image processing (to be described later) analyzes image data obtained by reading the image by the reading unit 6, and generates a color correction parameter.

In order to discharge inks of four colors, C (Cyan), M (Magenta), Y (Yellow), and K (blacK) and print, the printhead 2 is formed from four heads 1C, 1M, 1Y, and 1K which discharge the respective inks.

Although the printing apparatus using the four, C, M, Y, and K inks is exemplified, the present invention is not limited to these ink colors. For example, the printing apparatus may use many inks of light cyan (LC), light magenta (LM), pale gray (PGy), red (R), and green (G).

Figure 2:
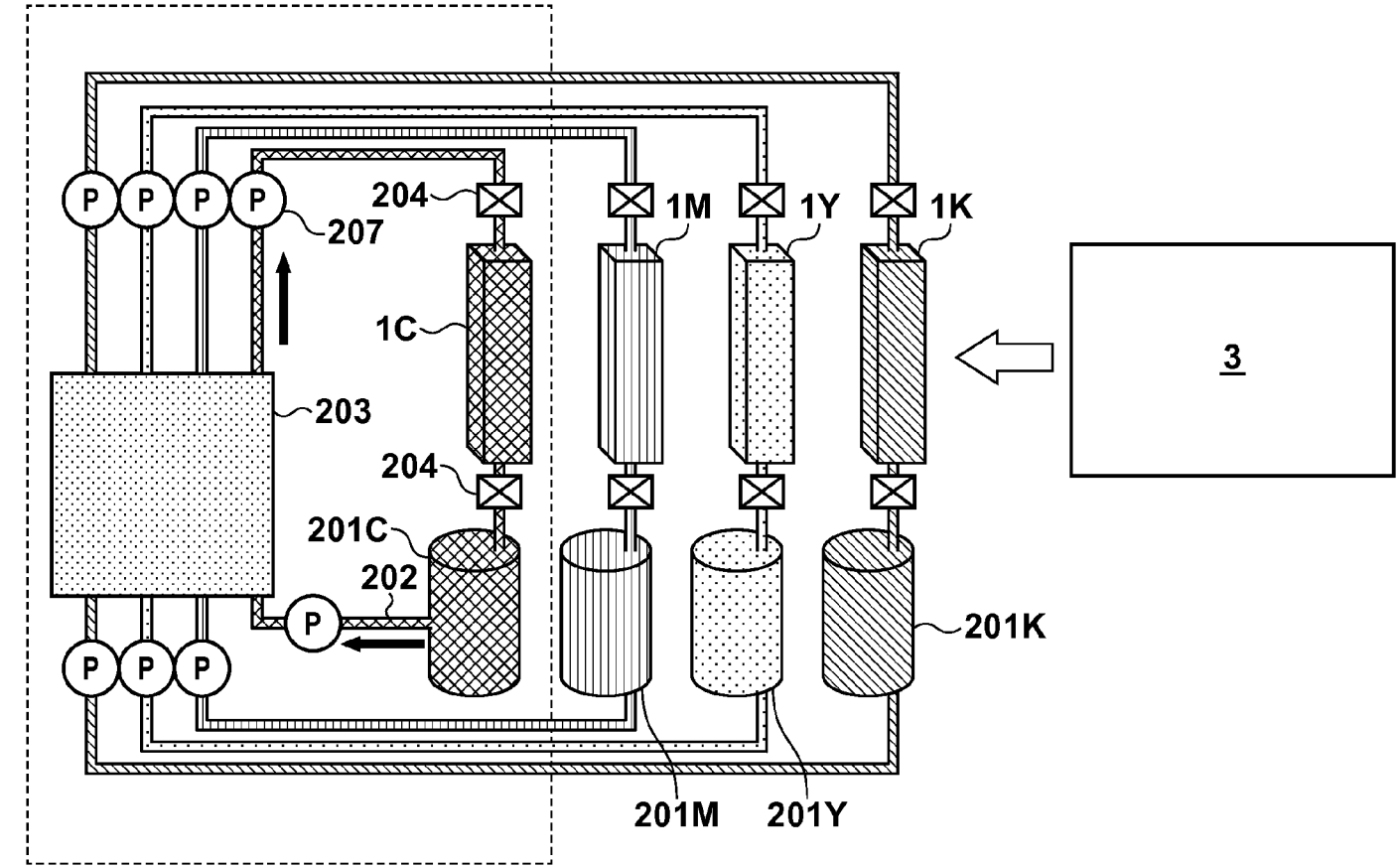
FIG. 2 is a view showing the relationship between a printhead, ink circulation channel, ink tank, pump, and ink temperature adjustment unit, which are used in the printing apparatus shown in FIGS. 1A and 1B.

FIG. 2 is a view showing the relationship between the printhead, ink circulation channel, ink tank, pump, and ink temperature adjustment unit, which are used in the printing apparatus shown in FIGS. 1A and 1B.

The printing apparatus shown in FIGS. 1A and 1B uses four inks. However, the relationship between the printhead, the ink circulation channel, the ink tank, the pump, and the ink temperature adjustment unit is the same between the respective inks. Thus, an arrangement for one cyan ink, surrounded by a dotted line in FIG. 2, will be explained.

Cyan ink used in printing is filled in an ink tank 201C. Even during ink circulation, ink can be supplied or an ink tank can be replaced. This arrangement can keep supplying ink even during continuous running without stopping the apparatus. Ink from the ink tank 201C flows inside an ink circulation channel 202 in a direction indicated by a solid arrow, and is supplied to an ink temperature adjustment unit 203. Since the ink flows through the ink temperature adjustment unit 203, stable-temperature ink can be supplied.

The ink having passed through the ink temperature adjustment unit 203 flows through an ink valve 204 and is supplied to the head 1C. The head 1C prints using the supplied ink. In the embodiment, the print medium (for example, print paper) 3 is conveyed in a direction indicated by an open arrow, and is printed at the timing when the print medium 3 is conveyed to below the head 1C. The ink valves 204 are arranged on the two sides of the head 1C, and tightly hold the ink in the ink circulation channel in head replacement. A pump 207 is operated to circulate the ink.

In this manner, the ink circulation mechanism also functioning as the ink temperature adjustment unit is applied to the arrangement in which the ink circulation channel and printhead are individually arranged for each ink. This can suppress temperature fluctuations of the printhead in the printing operation to a certain degree.

In the embodiment, the ink tank 201C, and ink tanks 201M, 201Y, and 201K which store C (Cyan), M (Magenta), Y (Yellow), and K (blacK) inks are arranged from left in FIG. 2. The ink arrangement order is held in a controller which controls ink circulation.

Although the form in which the ink tanks are arranged in the order of C, M, Y, and K is explained, the present invention is not limited by the ink tank arrangement order, as a matter of course. Note that the ink type used in the printing apparatus and the ink tank arrangement order may be changed. In this case, it may be better to adopt an ink circulation channel cleaning mechanism, and a mechanism which associates a position upon a change of the ink type with an ink type. The advantages of the present invention can be obtained regardless of the ink tank arrangement order in the printing apparatus.

Figure 3:
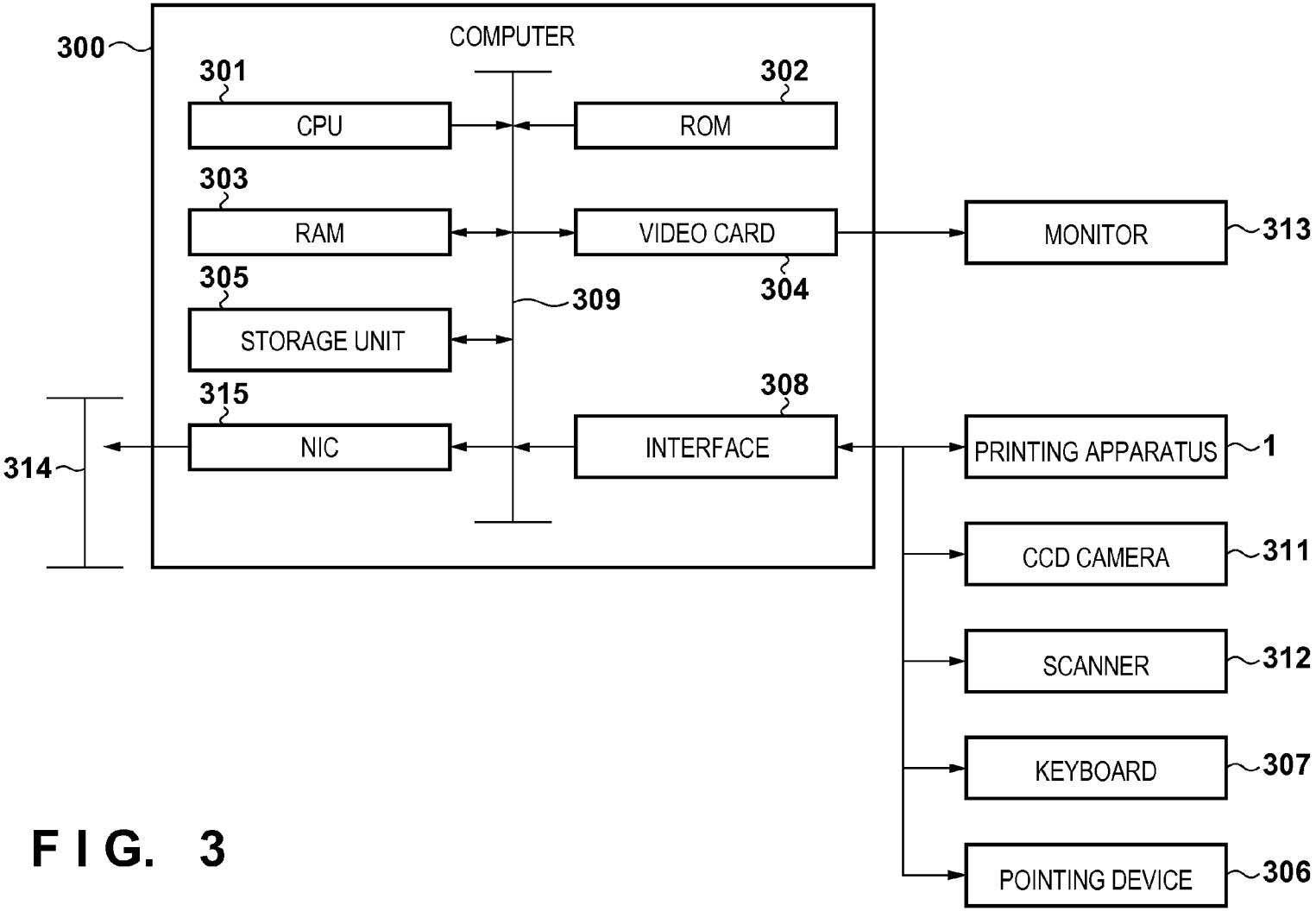
FIG. 3 is a block diagram showing the control arrangement of the printing apparatus shown in FIGS. 1A and 1B.

FIG. 3 is a block diagram showing the control arrangement of the printing apparatus shown in FIGS. 1A and 1B.

An information processing apparatus (computer) 300 includes a CPU 301, a ROM 302, a RAM 303, and a video card 304 for connecting a monitor 313 (which may include a touch panel). As a storage unit 305, the information processing apparatus 300 includes a hard disk drive and memory card. Also, the information processing apparatus 300 includes a serial bus interface 308 such as a USB or IEEE1394 interface for connecting a pointing device 306 such as a Mouse®, stylus, or tablet, and a keyboard 307. Further, the information processing apparatus 300 includes a network interface card (NIC) 315 for connecting a network 314. These building components are connected to each other via a system bus 309.

The serial bus interface 308 allows connecting the printing apparatus 1, a CCD camera 311, and a scanner 312.

The information processing apparatus 300 can receive image data from an apparatus which optically acquires image data, such as a digital camera or digital video camera, or a portable medium such as a magnetic disk, optical disk, or memory card. An image file may contain the input image data.

The CPU 301 loads a program (including an image processing program to be described later) stored in the ROM 302 or storage unit 305 into the RAM 303 serving as a work area, and executes it. The CPU 301 controls the building elements via the system bus 309 in accordance with the program, implementing the function of the program. The storage device such as the ROM 302, RAM 303, or the storage unit 305 stores information about an optimal driving condition of the printhead, and a color correction parameter. The information may be any type of information as long as it represents driving conditions.

Figure 4A:
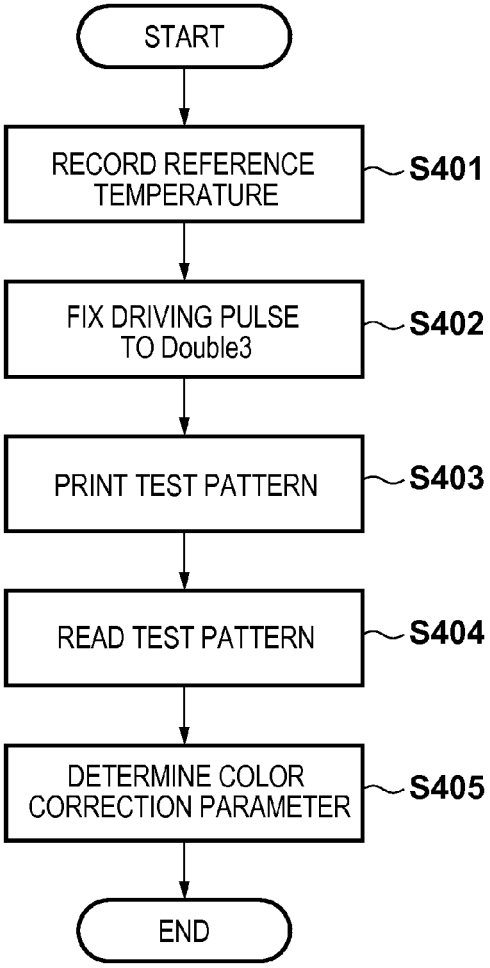
FIGS. 4A and 4B are flowcharts showing a processing sequence to select an optimal driving pulse in accordance with the printhead temperature.
Figure 4B:
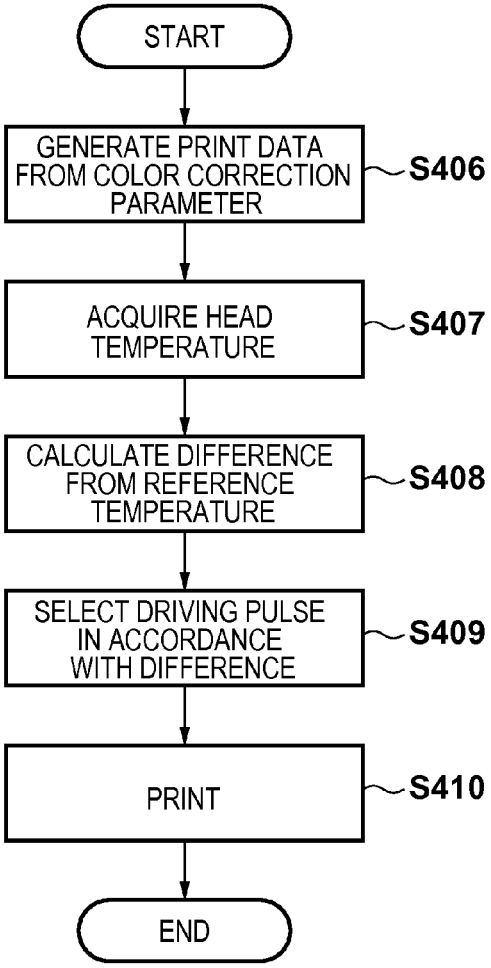

FIGS. 4A and 4B are flowcharts showing a processing sequence to select an optimal driving pulse in accordance with the printhead temperature. This sequence is formed from two types of processes, that is, an operation in the printing apparatus maintenance mode (first mode) and an operation in the normal printing mode (second mode). FIG. 4A shows a processing sequence in the maintenance mode, and FIG. 4B shows a processing sequence in the normal printing mode.

First, a processing sequence in the maintenance mode will be explained.

In step S401, a temperature is acquired from a temperature sensor integrated in each of a plurality of chips forming the printhead, and stored. This temperature is set as a reference temperature Tref. The arrangement position of the temperature sensor mounted on the printhead will be explained.

Figure 5A:
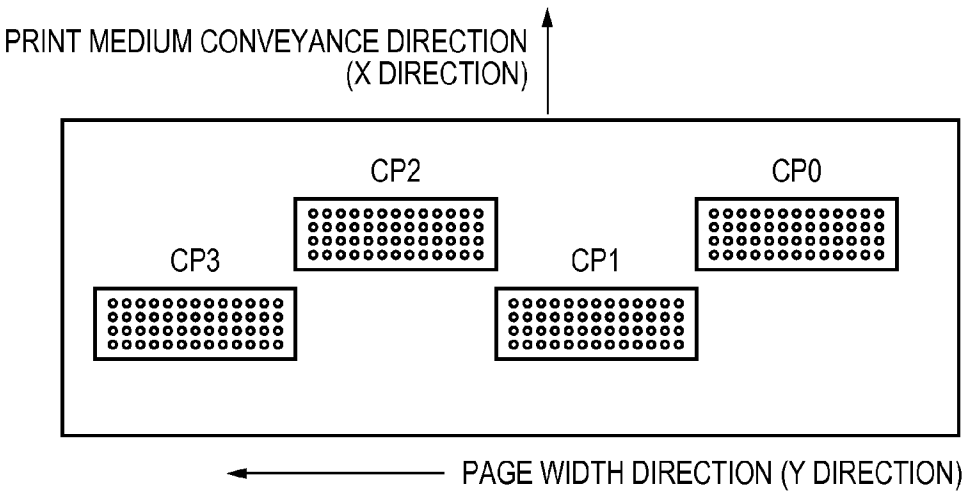
FIGS. 5A and 5B are views showing the relationship between the nozzle arrangement of the printhead and the temperature sensor.
Figure 5B:
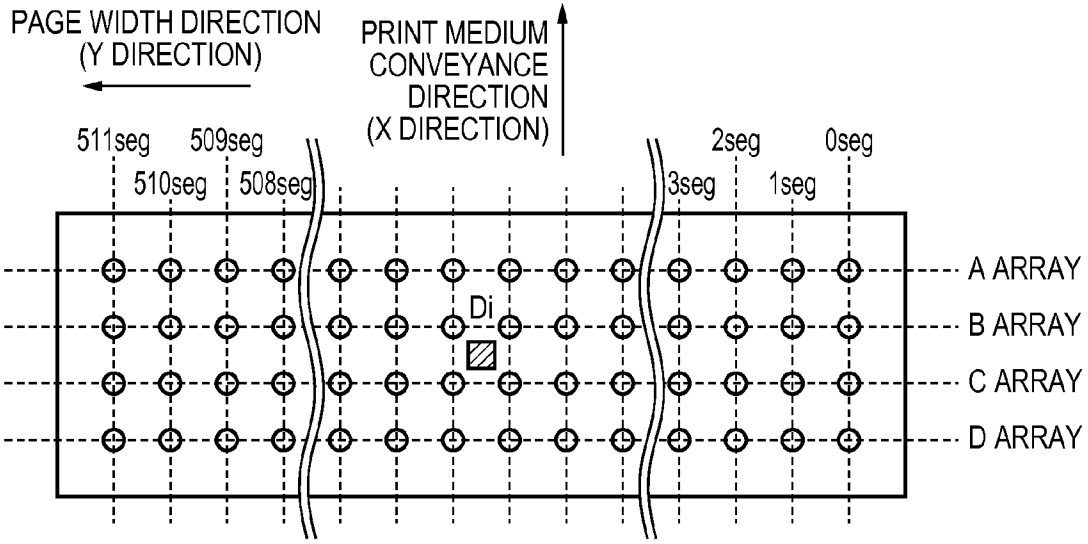

FIGS. 5A and 5B are views showing the relationship between the nozzle arrangement of the printhead and the temperature sensor.

FIG. 5A shows the chip arrangement of one head. In FIG. 5A, the vertical direction (X direction) is the print medium conveyance direction. In the arrangement shown in FIG. 5A, a plurality of head chips are staggered in a direction (Y direction) perpendicular to the print medium conveyance direction, forming a full-line head.

FIG. 5B is an enlarged view of one chip shown in FIG. 5A.

As shown in FIG. 5B, four nozzle arrays (A array, B array, C array, and D array), each having 512 nozzles 0 Seg to 511 Seg, are arranged in the X direction on each chip. A temperature sensor Di is arranged at the center of the chip. As the temperature sensor Di, a diode sensor is formed on the same silicon chip as that for an ink discharge heater. This is because the cost can be reduced by manufacturing the temperature sensor Di by film forming, and the formation of the temperature sensor Di on a silicon (Si) substrate having high thermal conductivity exhibits a good response to a temperature change.

When the relationship between the temperature and the voltage in the sensor is given by a linear function ($y=ax+b$), the gradient (a) can be suppressed with respect to variations in the semiconductor manufacturing process. However, it is difficult to suppress the offset (b) within the tolerable range in actual use. This embodiment appropriately determines the offset amount.

For descriptive convenience, the embodiment has described an example of arranging a single temperature sensor on one chip. However, for example, an arrangement in which a plurality of temperature sensors are arranged on one chip in the print medium (print paper) width direction and print medium conveyance direction may be employed.

When acquiring a head temperature, noise reduction processing is also very important. This is because the temperature sensor is formed on the same silicon chip as that for an ink discharge heater, and thus has a drawback in which the temperature sensor is readily affected by an ink discharge driving pulse which serves as a noise. To solve this drawback, many methods have been proposed, including a method of acquiring a temperature at the timing when no ink discharge driving pulse is input, and a method of suppressing noise by a wiring method. The present invention is therefore adaptable to all systems which remove sensor noise, regardless of their methods.

In step S402, the driving pulse is fixed to Double3. Details of the driving pulse will now be explained. In a thermal inkjet printing apparatus, it is generally known that an ink droplet amount to be discharged from the nozzle can be changed by changing the pulse waveform of a current to be supplied to the heater of the printhead.

Figure 7:
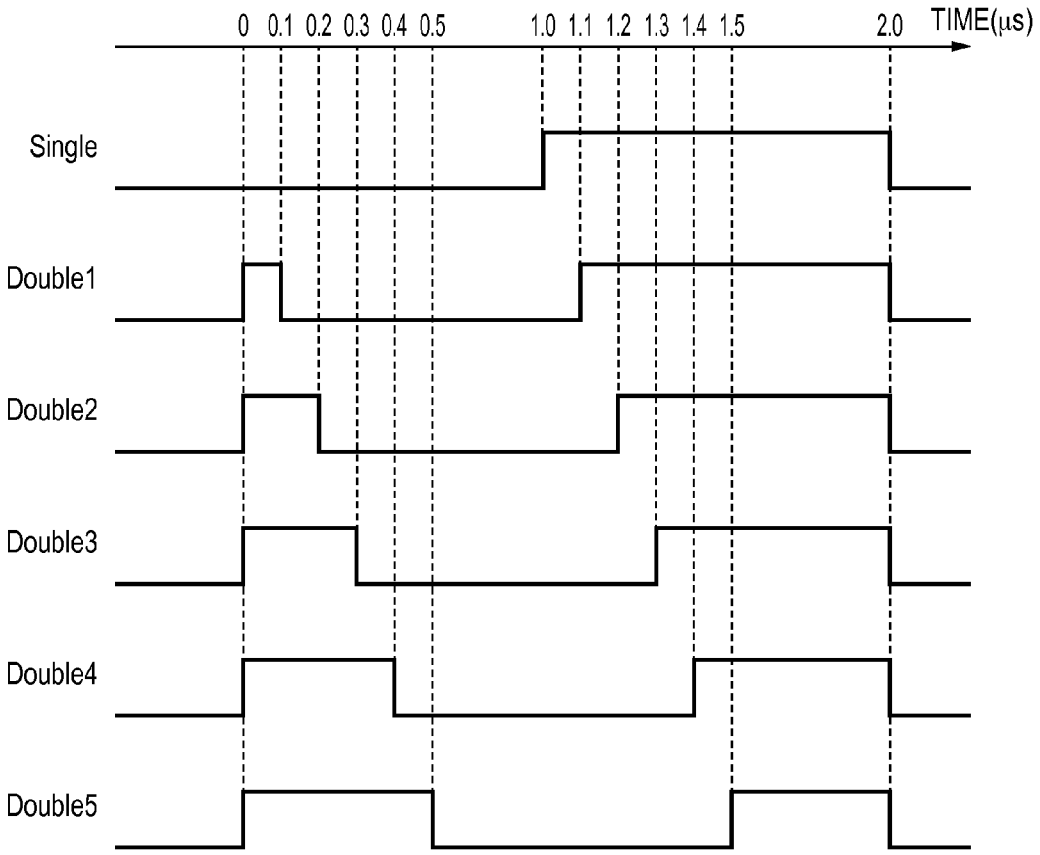
FIG. 7 is a timing chart showing the waveforms of a plurality of driving pulses defined in FIG. 6.

FIG. 6 is a table showing definition of a plurality of driving pulses used in the printhead by a time. FIG. 7 is a timing chart showing the waveforms of a plurality of driving pulses defined in FIG. 6. In FIGS. 6 and 7, each driving pulse is formed from a pre-pulse and main-pulse, and the pre-pulse and main-pulse have different pulse widths. As the pulse type, six types of driving pulses which are Single with the pre-pulse having a pulse width of 0, Double1, Double2, Double3, Double4, and Double5 are illustrated. That is, one single pulse and five double pulses are illustrated.

As is apparent from FIGS. 6 and 7, the current waveform of the driving pulse to be input to the heater differs between a plurality of driving pulses. More specifically, the ink droplet amount can be adjusted by mainly adjusting the pulse width of the pre-pulse. When ink is discharged by changing the driving pulse sequentially from Single to Double5 while the head substrate temperature remains unchanged, the ink droplet amount increases sequentially. The embodiment uses Double3 as a driving pulse in test pattern printing. This pulse will also be called the first driving pulse.

In step S403, a test pattern is printed. As for the test pattern, many proposals have been made. For example, a layout method for a test pattern which reduces an error has been proposed. Since the embodiment of the present invention does not focus on the test pattern itself, any type of the test pattern may be used.

In step S404, the printed test pattern is read. In this case, any type of the reading apparatus may be used, and a reading apparatus such as a colorimeter, scanner, or camera is usable. Although the embodiment will exemplify the scanner, the other type of the reading apparatus may be acceptable. Although the embodiment will explain a form in which the printing apparatus and reading apparatus are integrated, the colorimeter or the like may be arranged separately from the printing apparatus. In such a case, the printed test pattern is manually set in the colorimeter and read. The advantages of the embodiment of the present invention are obtained regardless of the reading form.

Finally, in step S405, a color correction parameter is determined based on image data obtained by reading the test pattern.

Next, general data processing in the printing apparatus will be explained with reference to a flowchart.

Figure 8:
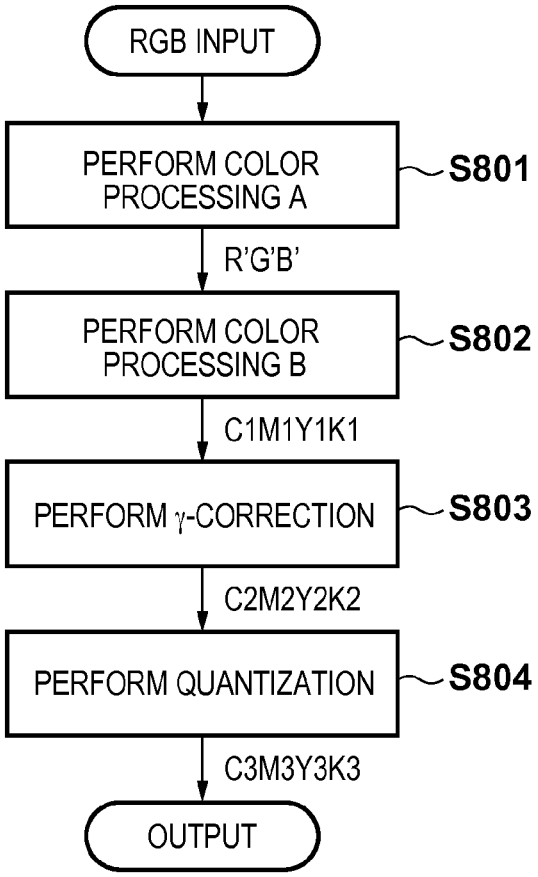
FIG. 8 is a flowchart showing image data processing to be executed by the printing apparatus.

FIG. 8 is a flowchart showing image data processing to be executed by the printing apparatus.

First, in step S801, the R, G, and B signals of an original image obtained by processing of an image input device such as a digital camera or scanner or the information processing apparatus (computer) are converted into R', G', and B' signals by color processing A. In color processing A, the R, G, and B signals of an original image are converted into image signals R', G', and B' adapted to the color reproduction range of the printing apparatus.

Then, in step S802, color processing B is executed to convert the R', G', and B' signals into density signals corresponding to respective color ink components. Since the printing apparatus according to the embodiment performs color printing using four color inks C, M, Y, and K, the converted signals are density signals C1, M1, Y1, and K1 corresponding to cyan, magenta, yellow, and black. In detailed color processing B, a three-dimensional lookup table (LUT) for R, G, and B inputs, and C, M, Y, and K outputs is used. For an input value deviating from a grid point, an output value is generally obtained by interpolation from the output values of surrounding grid points.

In step S803, γ-correction is executed using a γ-conversion correction table, obtaining γ-corrected density signals C2, M2, Y2, and K2 from the density signals C1, M1, Y1, and K1. Generally in the γ-correction, conversion processing is performed using a one-dimensional LUT, details of which will be described later.

Finally, in step S804, the γ-corrected density signals C2, M2, Y2, and K2 undergo quantization processing, obtaining binary image signals C3, M3, Y3, and K3. The binary image signals are transferred to the respective heads. As the quantization (binarization) method, an error diffusion method or dither method is used. The dither method is a method of performing binarization using predetermined dither patterns having different thresholds for the density signals of respective pixels.

The embodiment will explain a γ-correction parameter as the color correction parameter.

Figure 9:
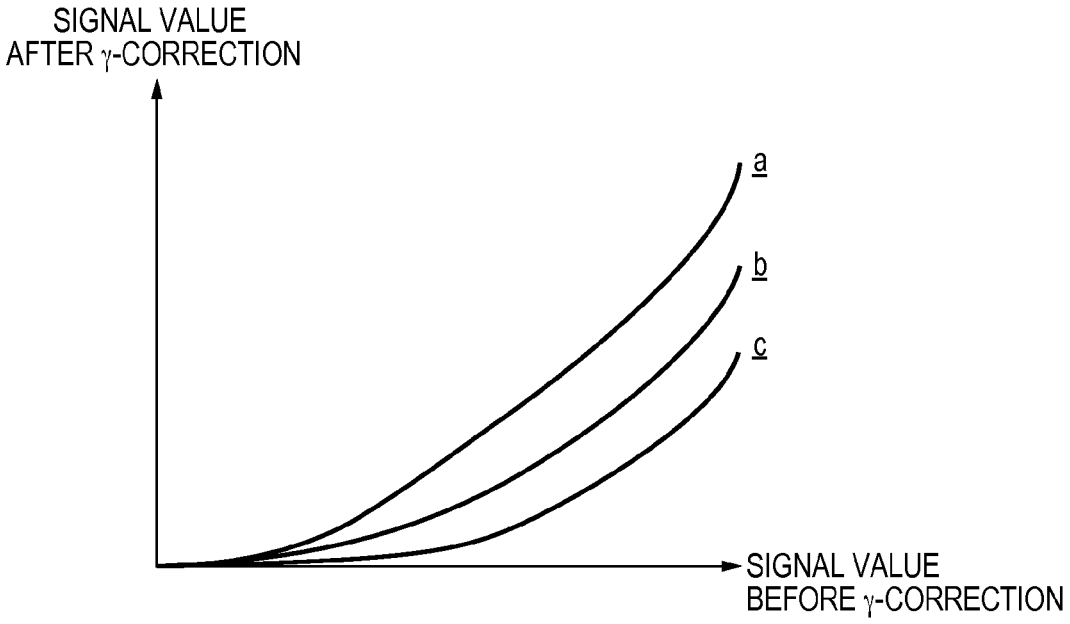
FIG. 9 is a graph showing a γ-curve for γ-correction.

FIG. 9 is a graph showing a γ-curve for γ-correction. In FIG. 9, the abscissa represents a density signal value corresponding to each color ink before γ-correction, and the ordinate represents a signal value after γ-correction.

In FIG. 9, a, b, and c correspond to one-dimensional LUTs created as color correction parameters. A γ-curve represented by a is applied to a head having a small ink discharge amount, a γ-curve represented by b is applied to a head having a standard ink discharge amount, and a γ-curve represented by c is applied to a head having a large ink discharge amount.

The printhead is an industrial product. In the manufacturing process, for example, the orifice diameter may vary, the amount of ink droplet to be discharged may change, and the amount of color material to be discharged onto the print paper surface may change. As a result, the color appearance by the printhead may change. In this case, the number of ink droplets to be discharged is decreased by decreasing an output value for a head having a large ink discharge amount by γ-correction, compared to a head having a standard ink discharge amount, so that the head having the large ink discharge amount can print in the same color as that by the head having the standard ink discharge amount. For a head having a small ink discharge amount, γ-correction is performed to increase the number of ink droplets to be discharged.

In this way, the color correction parameter assumed in the embodiment changes the number of droplets to be discharged in accordance with the discharge amount of the head in γ-correction.

However, the present invention is applicable regardless of what kind of correction parameter is created, other than γ-correction processing. For example, color processing A may perform correction or both color processing A and γ-correction may perform it. That is, the present invention is applicable regardless of the type of color correction to be executed.

Although general data processing in the printing apparatus has been exemplified, there is a printing apparatus which executes other various data processes. However, the present invention is applicable to an apparatus which prints regardless of data processing. The present invention is, therefore, not limited to a printing apparatus which executes the above-described data processing.

The correction parameter determined by the above processing is stored in the nonvolatile memory of the storage device, and can be referred to in image processing when performing normal printing later.

Referring back to FIG. 4B, a processing sequence in the normal printing mode will now be described.

First, in step S406, print data is generated based on input image data and the correction parameter created in step S405.

Then, in step S407, head temperature information is acquired. The acquired temperature is set as T1. The head temperature acquisition is the same processing as that in step S401, and a detailed description thereof will not be repeated here. In step S408, the difference value between the temperature acquired in step S407 and the reference temperature stored in step S401 is calculated. Letting T1_dif be the calculated difference value, T1_dif is given by $$T1_dif = T1 - Tref$$

In step S409, a driving pulse is selected in accordance with T1_dif calculated in step S408. The selected driving pulse will also be called the second driving pulse. In general, as the head temperature rises, the ink viscosity decreases, a bubble becomes large, and a droplet to be discharged from the nozzle tends to increase. To compensate the increase, it is controlled to select a pulse close to Double5 when the head temperature is low, and a pulse close to Single when it is high. By this control, it is controlled to discharge an ink droplet by almost the same amount as that used when a test pattern was printed.

FIGS. 10A and 10B are tables showing the relationship between the head temperature and a driving pulse to be selected.

FIG. 10A shows the relationship between the head temperature of a well-known product and the driving pulse. In this example, the head temperature and driving pulse have a relationship represented by the table of a relation which links a temperature of an absolute value to a driving pulse. In this case, an absolute value detected by the temperature sensor is very important.

FIG. 10B shows the relationship between the head temperature and the driving pulse according to the embodiment. In the embodiment, subsequent control is performed based on a difference from the reference temperature acquired in step S401, so the temperature shown in FIG. 10B is a temperature relative to the reference temperature. FIG. 10B is a table of a relation which links the relative temperature to a driving pulse.

For descriptive convenience, FIGS. 10A and 10B show an example in which one type of driving pulse is assigned to every temperature step of 5° C. However, recent demand for higher image qualities is very strong, and higher-temperature-resolution control is required in actual control. In this case, the number of types of driving pulses is further increased, and for example, the relation between the temperature and the driving pulse may be prepared at every step of 1° C. Needless to say, the advantages of the embodiment of the present invention can be obtained regardless of the unit for controlling the head temperature and driving pulse.

Finally, in step S410, printing is performed based on the print data generated in step S406 using the driving pulse selected in step S409.

According to the above-described embodiment, a head temperature in the operation in the maintenance mode is set as a reference temperature. In the normal printing mode, printing can be performed by selecting a driving pulse in accordance with a temperature relative to the reference temperature. Since a correction parameter generated in the maintenance mode is reflected in image data processing in the normal printing mode, the absolute detection temperature accuracy of the temperature sensor becomes less important, and a system for calibrating the temperature sensor becomes unnecessary. As a result, the cost of the printing apparatus main body can be reduced.

Note that the processing has been described from test pattern printing. However, for example, when a printhead is externally introduced and mounted in the printing apparatus, the printhead itself may not be satisfactorily adapted to the environment of the printing apparatus. In this case, for example, a determination sequence may be added to acquire a head temperature log for about 30 seconds before test pattern printing, and determine whether or not the head temperature log does not vary by more than a predetermined range. Before test pattern printing, it can be confirmed that the head temperature is stabilized, and then a reference temperature can be acquired. Especially when the ink circulation system and ink temperature control system are employed as in the printing apparatus according to the embodiment, the head temperature can be stabilized more quickly.

In the above-described embodiment, the reference temperature is acquired before test pattern printing. However, the main purpose of the present invention is to set a temperature in test pattern printing as a reference, and input an appropriate driving pulse selected based on a temperature difference from the reference temperature in subsequent printing. For this reason, the reference temperature may be acquired during test pattern printing or after printing, instead of acquiring a reference temperature before test pattern printing as in the above description. However, by acquiring a reference temperature before test pattern printing, drive control can be advantageously performed based on a temperature difference from the reference temperature even during test pattern printing.

As described above, the embodiment pays attention to calculation of the offset value of the Di sensor. As described above, the temperature sensor has two error factors, that is, offset and gradient, and the offset is a main error factor. However, the gradient can also be an error factor though it is less influential. In a temperature sensor other than the Di sensor, even the gradient can cause a large error. In this case, a sequence to correct even the gradient is added. More specifically, ink is discharged for a predetermined time after step S403 in FIG. 4A, and a rise of the head temperature is measured. Then, a rise of a temperature sensor having an ideal gradient and the measured rise of the head temperature are compared, and a coefficient by which the temperature gradient is to be multiplied is calculated. By adding this sequence, desirable control which corrects even the error factor of the gradient component of the temperature sensor can be implemented.

Further, in the above-described embodiment, an appropriate driving pulse is selected based on a temperature relative to that in test pattern printing. However, for example, an absolute value is necessary in protection control which stops the running of the apparatus when the temperature sensor value reaches the threshold, in order to prevent the heater temperature from becoming excessively high and damaging another circuit and the like near the heater. In this case, control may be performed based on a temperature sensor having a lowest detected temperature so that the apparatus can operate most stably based on the manufacturing tolerance of the temperature sensor of the head. As a result, an apparatus which ensures a stable operation without calibrating the absolute value of the temperature sensor of the head can be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-137269, filed Jun. 18, 2012, which is hereby incorporated by reference herein in its entirety.

What is claimed is:

1. A printing apparatus for printing images, comprising a print head having a substrate, a plurality of heaters which are driven by supplying a driving pulse to discharge ink and arranged on the substrate, and a temperature sensor which is arranged on the substrate;

a first obtaining unit configured to obtain first information regarding a temperature detected by the temperature sensor at a first timing;

a first printing control unit configured to control printing of a test pattern which is used for correcting input image data for printing an image based on a predetermined driving pulse at a timing near the first timing;

a second obtaining unit configured to obtain second information regarding a temperature detected by the temperature sensor at a second timing after the first timing;

a third obtaining unit configured to obtain third information regarding a temperature difference between the temperature indicated by the first information obtained by the first obtaining unit and the temperature indicated by the second information obtained by the second obtaining unit;

a determining unit configured to determine a first driving pulse to be supplied to the plurality of heaters based on the temperature difference indicated by the third information obtained by the third obtaining unit; and a second printing control unit configured to control printing of the image by supplying the first driving pulse determined by the determining unit to the plurality of heaters at a timing near the second timing.

2. The printing apparatus according to claim 1, wherein the first driving pulse comprises a main-pulse and a pre-pulse which is supplied before the main-pulse.

3. The printing apparatus according to claim 1, wherein the determining unit determines the first driving pulse, in a case where the temperature indicated by the second information obtained by the second obtaining unit is higher than the temperature indicated by the first information obtained by the first obtaining unit, such that (i) a length of the pre-pulse of the first driving pulse determined by the determining unit is a first length in a case where the temperature difference indicated by the third information by the third obtaining unit is a first value, and (ii) the length of the pre-pulse of the first driving pulse determined by the determining unit is a second length which is shorter than the first length in a case where the temperature difference indicated by the third information by the third obtaining unit is a second value which is greater than the first value.

4. The printing apparatus according to claim 3, wherein the determining unit determines the first driving pulse, in a case where the temperature indicated by the second information obtained by the second obtaining unit is higher than the temperature indicated by the first information obtained by the first obtaining unit, such that (i) the length of the pre-pulse of the first driving pulse determined by the determining unit is the first length in a case where the temperature indicated by the first information obtained by the first obtaining unit is a first temperature and the temperature indicated by the second information obtained by the second obtaining unit is a second temperature, and (ii) the length of the pre-pulse of the first driving pulse determined by the determining unit is the second length in a case where the temperature indicated by the first information obtained by the first obtaining unit is a third temperature which is lower than the first temperature and the temperature indicated by the second information obtained by the second obtaining unit is the second temperature.

5. The printing apparatus according to claim 2, wherein the determining unit determines the first driving pulse, in a case where the temperature indicated by the second information obtained by the second obtaining unit is higher than the temperature indicated by the first information obtained by the first obtaining unit, such that a length of the pre-pulse of the first driving pulse is shorter than a length of the pre-pulse of the predetermined driving pulse.

6. The printing apparatus according to claim 2, wherein the determining unit determines the first driving pulse, in a case where the temperature indicated by the second information obtained by the second obtaining unit is lower than the temperature indicated by the first information obtained by the first obtaining unit, such that (i) a length of the pre-pulse of the first driving pulse determined by the determining unit is a first length in a case where the temperature difference indicated by the third information by the third obtaining unit is a first value, and (ii) the length of the pre-pulse of the first driving pulse determined by the determining unit is a second length which is longer than the first length in a case where the temperature difference indicated by the third information by the third obtaining unit is a second value which is greater than the first value.

7. The printing apparatus according to claim 6, wherein the determining unit determines the first driving pulse, in a case where the temperature indicated by the second information obtained by the second obtaining unit is lower than the temperature indicated by the first information obtained by the first obtaining unit, such that (i) the length of the pre-pulse of the first driving pulse determined by the determining unit is the first length in a case where the temperature indicated by the first information obtained by the first obtaining unit is a first temperature and the temperature indicated by the second information obtained by the second obtaining unit is a second temperature, and (ii) the length of the pre-pulse of the first driving pulse determined by the determining unit is the second length in a case where the temperature indicated by the first information obtained by the first obtaining unit is a third temperature which is higher than the first temperature and the temperature indicated by the second information obtained by the second obtaining unit is the second temperature.

8. The printing apparatus according to claim 2, wherein the determining unit determines the first driving pulse, in a case where the temperature indicated by the second information obtained by the second obtaining unit is lower than the temperature indicated by the first information obtained by the first obtaining unit, such that a length of the pre-pulse of the first driving pulse is longer than a length of the pre-pulse of the predetermined driving pulse.

9. The printing apparatus according to claim 1, further comprising:

a first generating unit configured to generate a correction parameter for correcting the input image data based on the test pattern printed by the first printing control unit; and a second generating unit configured to generate print data based on the input image data and the correction parameter generated by the first generating unit, wherein the second printing control unit controls printing of the image based on the print data generated by the second generating unit.

10. The printing apparatus according to claim 9, further comprising a reading unit configured to read the test pattern printed by the first printing control unit, wherein the first generating unit generates the correction parameter based on a reading result of the test pattern read by the reading unit.

11. The printing apparatus according to claim 9, wherein the correction parameter includes a γ-correction parameter.

12. The printing apparatus according to claim 1, further comprising:

a memory configured to store a plurality of driving pulses including the predetermined driving pulse, wherein the determining unit determines the first driving pulse among the plurality of driving pulses stored in the memory.

13. The printing apparatus according to claim 1, wherein the first printing control unit controls printing of the test pattern at a timing after the first timing.

14. The printing apparatus according to claim 1, wherein the second printing control unit controls printing of the image at a timing after the second timing.

* * * * *